US009223275B2

(12) United States Patent
Totsuka

(10) Patent No.: US 9,223,275 B2
(45) Date of Patent: Dec. 29, 2015

(54) IMAGE FORMING APPARATUS, METHOD FOR CONTROLLING IMAGE FORMING APPARATUS, AND STORAGE MEDIUM STORING PROGRAM

(71) Applicant: CANON KABUSHIKI KAISHA, Tokyo (JP)

(72) Inventor: Satoshi Totsuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/458,346

(22) Filed: Aug. 13, 2014

(65) Prior Publication Data

US 2015/0055971 A1 Feb. 26, 2015

(30) Foreign Application Priority Data

Aug. 21, 2013 (JP) ..... 2013-171710

(51) Int. Cl.
*G03G 21/00* (2006.01)
*G03G 15/00* (2006.01)

(52) U.S. Cl.
CPC ..... *G03G 15/5004* (2013.01); *G03G 15/502* (2013.01); *G03G 2215/00392* (2013.01); *G03G 2215/00725* (2013.01)

(58) Field of Classification Search
CPC ..... G03G 2215/00392; G03G 2215/00725; G03G 15/5004
See application file for complete search history.

(56) References Cited

U.S. PATENT DOCUMENTS

| | | | | |
|---|---|---|---|---|
| 7,120,372 | B2 * | 10/2006 | Kim et al. | 399/70 |
| 2004/0146313 | A1 * | 7/2004 | Uchizono et al. | 399/75 |
| 2007/0263242 | A1 * | 11/2007 | Takahashi | 358/1.14 |
| 2009/0207423 | A1 * | 8/2009 | Shimizu et al. | 358/1.1 |

FOREIGN PATENT DOCUMENTS

| | | | |
|---|---|---|---|
| JP | 2006195253 A | * | 7/2006 |
| JP | 2011-193113 A | | 9/2011 |

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus has a first electric power state and a second electric power state in which power consumption is smaller than that in the first electric power state. It is determined whether or not to display a screen for setting information of a sheet held in a sheet holding unit on a display unit, in accordance with whether a factor in a transition is a first factor that is detection of the sheet being held in the sheet holding unit or a second factor that is different from the first factor, after the image forming apparatus is caused to transition from the second electric power state to the first electric power state.

12 Claims, 6 Drawing Sheets

IMAGE FORMING APPARATUS, METHOD FOR CONTROLLING IMAGE FORMING APPARATUS, AND STORAGE MEDIUM STORING PROGRAM

BACKGROUND OF THE INVENTION

1. Field of the Invention

The present invention relates to an image forming apparatus, a method for controlling the image forming apparatus, and a storage medium storing a program.

2. Description of the Related Art

A conventional image forming apparatus is provided with a manual bypass tray for feeding various sizes and types of paper. Upon a user placing paper in the manual bypass tray, a paper detection sensor of the manual bypass tray detects the paper, and a setting/registration screen for manually inserted paper is displayed on a UI screen in order to have the user designate the size and type of the paper. This setting/registration screen for manually inserted paper is displayed when a state where there is no paper in the manual bypass tray changes into a state where paper exists therein. The user can print the paper fed from the manual bypass tray by setting the type and size of the paper placed in the manual bypass tray, via the setting/registration screen. If the manual bypass tray has an automatic paper size detection function, upon the user placing paper in the manual bypass tray, a standard size that is closest to the detected paper size is estimated, and the estimated standard size can be displayed by default on the setting/registration screen for manually inserted paper. In this case, the user can complete registration of the manually inserted paper only by placing the paper in the manual bypass tray and setting the paper type via the setting/registration screen.

Meanwhile, a conventional image forming apparatus has a power-saving function of stopping electric power supply to hardware such as a printer engine, a scanner engine, and a display unit in an operation unit and causing the apparatus to transition to a power-saving mode, if an operation request is not given from the user for a certain time period or longer. In this power-saving mode, various sensors and the like that provide factors in returning to a standby mode continue to be energized, and the apparatus transitions to the standby mode upon an event serving as a factor in returning from the power-saving mode being detected. Events serving as the returning factors include pressing a return button for giving an instruction to return from a sleep state (power-savings mode), as well as detection of paper in the manual bypass tray, opening and closing of a platen, reception of network packets, detection of opening of a front door, and the like. Interrupt signals from sensors for detecting these events serving as the returning factors are input to a CPU in a main control unit, and occurrence of the events serving as the returning factors are thus detected.

Here, a logical sum of interrupt signals from some sensors is obtained and supplied to the CPU in order to reduce the number of pins to be input to the CPU in the main control unit. For this reason, it cannot be determined based on the signal of this logical sum which event the returning factor is. For example, assume a case where a signal of a logical sum of a signal indicating paper detection at the manual bypass tray and signals of other sensors is supplied to the CPU. At this time, for example, if paper placed in the manual bypass tray is replaced when in a power-saving state and thereafter the apparatus returns from the power-saving state due to a factor other than paper detection at the manual bypass tray, the setting/registration screen for manually inserted paper is not displayed.

Japanese Patent Laid-Open No. 2011-193113 discloses a technique of measuring the time at which a feed cassette is opened and closed when in a sleep state, determining that paper has been changed if it is detected that the feed cassette is opened a certain time period or longer, and storing information thereof.

Here, assume a case where paper is set in the manual bypass tray before the apparatus transitions to the power-saving state, and the apparatus returns from the power-saving state as a result of the user replacing paper in the manual bypass tray with a different kind of paper while in the power-saving state. In this case, since a signal of a logical sum of a signal indicating paper detection at the manual bypass tray and signals from other sensors is supplied to the CPU, the CPU cannot recognize the cause of the returning from the power-saving state. In such a case, the setting/registration screen for the paper set in the manual bypass tray is not displayed when the apparatus returns from the power-saving state. For this reason, manual bypass tray paper information is not updated to information regarding the newly-set paper, and therefore paper of a type which is different from the type provided in print conditions set by a print job may possibly be fed from the manual bypass tray and printed. In this case, a problem arises in that the quality of an image printed on this paper is degraded, resulting in wasteful use of paper.

SUMMARY OF THE INVENTION

An aspect of the present invention is to eliminate the above-mentioned problems with the conventional technology.

The present invention provides a technique that enables a user to appropriately configure settings of manually inserted paper at the time of returning from a power-saving state, even if paper in a manual feed unit is changed while in the power-saving state.

The present invention in one aspect provides an image forming apparatus having a first electric power state and a second electric power state in which power consumption is smaller than that in the first electric power state, comprising: a transition unit configured to cause the image forming apparatus to transition from the second electric power state to the first electric power state in accordance with a first factor that is detection of a sheet being held in a sheet holding unit, or a second factor that is different from the first factor; and a control unit configured to determine whether or not to display a screen for setting information of the sheet held in the sheet holding unit on a display unit, in accordance with whether a factor in the transition by the transition unit is the first factor or the second factor, after the image forming apparatus is caused to transition from the second electric power state to the first electric power state by the transition unit.

According to the present invention, even if the returning from the power-saving state is based on an interrupt signal of a logical sum of sensor signals, it is determined whether or not the returning is based on paper detection at the manual feed unit, and if so, the setting screen for configuring settings of manually inserted paper is displayed. Thus, even if paper in the manual feed unit is changed while in the power-saving state, the user can appropriately set the manually inserted paper at the time of the returning from the power-saving state.

Further features of the present invention will become apparent from the following description of exemplary embodiments with reference to the attached drawings.

DESCRIPTION OF THE EMBODIMENTS

Figure 1:
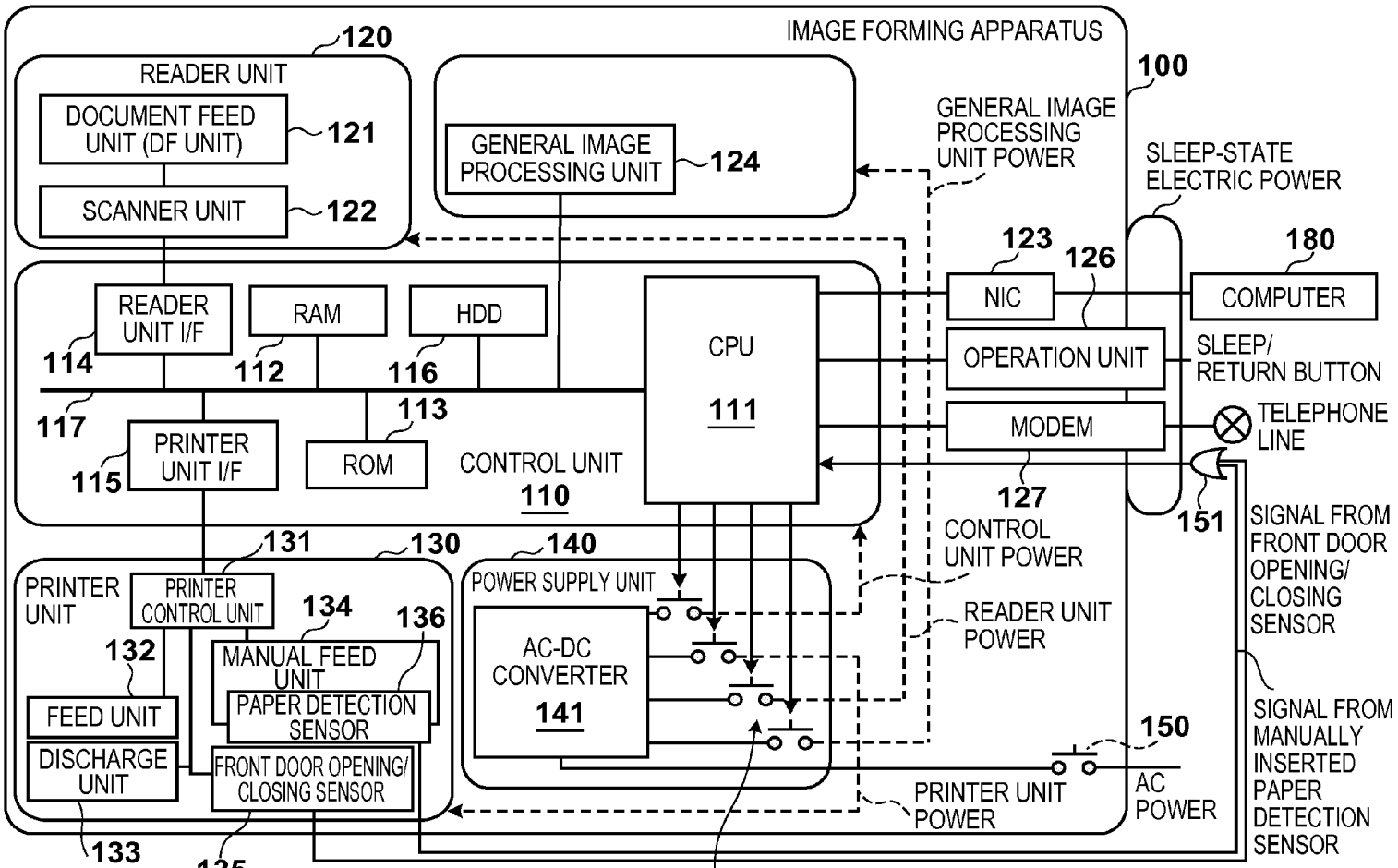
FIG. 1 is a block diagram showing a hardware configuration of an image forming apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. The same reference numerals will be given to the same constituent elements, and descriptions thereof will be omitted.

FIG. 1 is a block diagram illustrating a hardware configuration of an image forming apparatus 100 according to an embodiment of the present invention.

The image forming apparatus 100 is connected to a computer 180 via a LAN such as Ethernet. The image forming apparatus 100 has a reader unit 120 that performs processing for reading image data, and a printer unit 130 that performs processing for outputting image data. The image forming apparatus 100 also has an operation unit 126 equipped with a keyboard for performing operations of inputting and outputting image data and a liquid-crystal panel for displaying/setting image data and various functions, and the like. The image forming apparatus 100 further has a HDD (hard disk drive) 116 capable of storing image data that is input from the reader unit 120 and image data generated based on code data received from the computer 180 via the LAN.

The reader unit 120 has an original feed unit 121 that conveys an original, and a scanner unit 122 that optically reads an image of the original and converts it into image data. The printer unit 130 is provided with a feed unit 132 including a plurality of feed cassettes that contain paper. The printer unit 130 transfers and fixes image data onto paper. A printer control unit 131 controls communication with a control unit 110. A discharge unit 133 discharges printed paper and performs sorting processing and stapling processing on the printed paper. The printer unit 130 is also provided with an opening/closing sensor 135 in a front door thereof, and a manual feed unit 134 having a manually inserted paper detection sensor 136. The printer control unit 131, upon receiving a detection signal from these sensors, notifies the control unit 110 of the state of the front door of the printer unit 130 and the state of the manual feed unit 134.

For example, the control unit 110 controls the reader unit 120 to read original image data, and controls the printer unit 130 to provide a copy function of printing the image data on paper. The control unit 110 also provides a scanner function of converting image data that is input from the reader unit 120 into code data and transmitting the code data to the computer 180 via a network. The control unit 110 also provides a printer function of converting code data received from the computer 180 via a network into image data and outputting the image data to the printer unit 130.

The control unit 110 includes a HDD 116 capable of storing data of a plurality of jobs, a CPU 111, a RAM (main storage device) 112, and a ROM 113. The CPU 111 sequentially loads programs stored in the ROM 113 and the HDD 116 into the RAM 112 and executes the programs, thereby realizing later-described various functions. Furthermore, the CPU 111 is connected to the reader unit 120 and the printer unit 130, and is also connected to a LAN and a telephone line, thereby controlling input and output of code data, image data, device information, and the like. The RAM 112 provides a system work memory that enables the CPU 111 to operate, and is also used as an image memory for temporarily storing image data. The ROM 113 functions as a boot ROM, and stores a boot program for the system. The HDD 116 can store system software, image data, and the like. A general image processing unit 124 has an image processing block capable of performing processing, such as compression, on image data stored in the RAM 112, and again storing the image data in the RAM 112. These devices are arranged on a system bus 117. A reader unit I/F 114 is connected to the reader unit 120. A printer unit I/F 115 is connected to the printer unit 130. The control unit 110 performs synchronized/non-synchronized conversion and control of image data through these I/Fs. An NIC (Network Interface Card) 123 is connected to the LAN, and inputs and outputs image data and apparatus information. A modem 127 is connected to the telephone line, and inputs and outputs image data and apparatus information.

A power supply unit 140 supplies electric power to each part of the image forming apparatus 100. AC power is cut off by a switch 150 when the apparatus is powered off. AC power is supplied to an AC-DC converter 141 and DC power is generated by turning on the switch 150. The power supply unit 140 can independently control electric power supply to the control unit 110, the reader unit 120, the printer unit 130, and the general image processing unit 124, in accordance with an instruction from the CPU 111. That is to say, the CPU 111 can operate switches 142 connected to the AC-DC converter 141 to turn on and off electric power supply to the respective parts. The CPU 111 uses these switches 142 to appropriately supply electric power to necessary portions of the image forming apparatus 100, and thereby performs electric power control so as to cause the apparatus to enter a sleep state (power-saving state) or a standby state.

The sleep state refers to a power-saving mode in which power consumption in the image forming apparatus 100 is reduced as much as possible. Peripheral devices of the CPU 111 are set into a general suspend state (ACPI-S3 etc.), and only parts capable of detecting a job or a user operation (sleep-state electric power) are energized. Thus, an electric power state where the power consumption in the overall apparatus is very small can be achieved. Specifically, the CPU 111 stores the state of the image forming apparatus 100 in a nonvolatile storage unit (e.g., a nonvolatile memory such as the HDD 116), and controls the switches 142 to shut off electric power supply to the control unit 110. Although the CPU 111 does not operate in this state, sleep-state electric power is supplied thereto by hardware, and accordingly the CPU 111 is in a state of being able to detect submission of a job and a user operation. For example, upon the CPU 111 detecting data reception from the NIC 123, an operation to the operation unit 126, or a signal from the manually inserted paper detection sensor 136 or the front door opening/closing sensor 135, electric power supply to the control unit 110 is turned on by hardware, and the apparatus enters the standby state. At this time, the CPU 111 reads out the state of each part of the apparatus stored in the HDD 116, reconfigures each part in the read state so as to set the state immediately before electric power supply to the control unit 110 is turned off, and the apparatus transitions to the standby state. Note that conditions of transition to the sleep state include that an operation request from the user is not generated in a preset time period, for example. In the sleep state, devices and sensors that provide factors in returning from the sleep state are energized, and the apparatus transitions to the standby state as a result of the CPU 111 detecting a signal of any of these devices and sensors. At this time, a logical sum of interrupt signals from these various sensors are obtained and supplied to the CPU 111, as described above.

In the present embodiment, a logical sum of a signal of the manually inserted paper detection sensor 136 in the manual feed unit 134 and a detection signal of the front door opening/closing sensor 135, which are the factors in returning from the sleep state from the printer unit 130, are obtained and supplied to the CPU 111. That is to say, only at the time of returning from the sleep state, the CPU 111 cannot determine, using only the interrupt signal, whether the returning factor is based on the manually inserted paper detection sensor 136 or the front door opening/closing sensor 135.

The standby state refers to a state where electric power is supplied to the control unit 110. In this state, the CPU 111 can receive an operation by an operator from the operation unit 126, a job submitted from the NIC 123 via the network, and the like. The CPU 111 supplies electric power to devices to be used and thereafter performs control so as to execute a predetermined job, in accordance with the received job.

Figure 2:
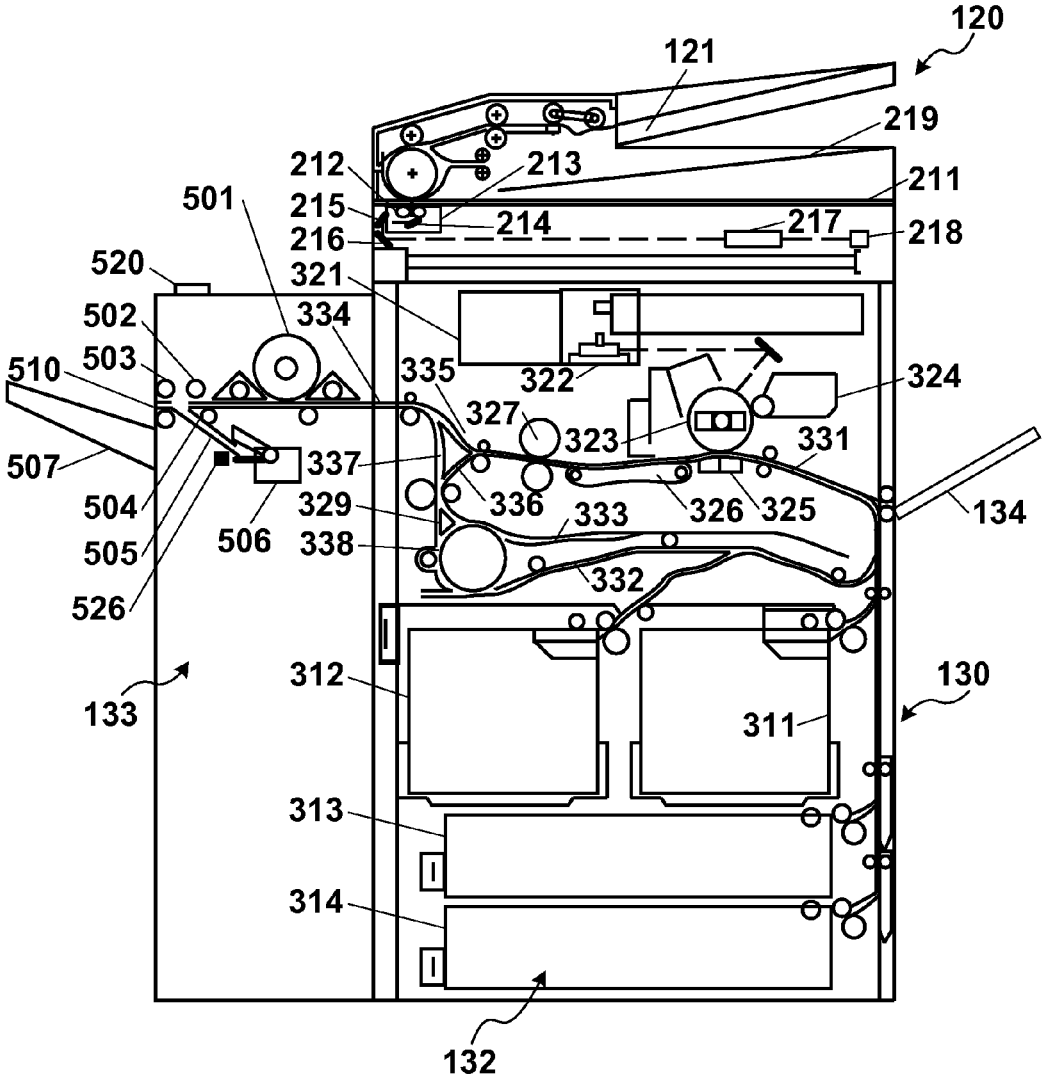
FIG. 2 is a cross-sectional view of a reader unit and a printer unit in the image forming apparatus.

FIG. 2 is a cross-sectional view of the reader unit 120 and the printer unit 130 in the image forming apparatus 100 according to the embodiment.

The reader unit 120 will be described first.

The original feed unit (DF unit) 121 sequentially feeds originals one-by-one from the top to a platen glass 211, and discharges the original on the platen glass 211 to a discharge tray 219 after finishing an operation of reading the original. Upon an original being conveyed onto the platen glass 211, a lamp 212 is lit on, movement of an optical unit 213 is started, and the original is exposed and scanned. Reflected light from the original at this time is guided to a CCD image sensor (hereinafter, CCD) 218 by mirrors 214, 215, and 216 and a lens 217. In this manner, an image of the scanned original is read by the CCD 218. An image signal that is output from the CCD 218 is subjected to predetermined processing, and is thereafter output as image data to the control unit 110.

Next, the printer unit 130 will be described.

A laser driver 321 drives a laser light-emitting unit 322 and causes the laser light-emitting unit 322 to emit a laser beam corresponding to the image data that is output from the control unit 110. A photosensitive drum 323 is irradiated with this laser beam, and a latent image corresponding to the laser beam is formed on the surface of the photosensitive drum 323. A developer is attached to the latent image portion on the photosensitive drum 323 by a developing device 324. The printer unit 130 has a cassette 311, a cassette 312, a cassette 313, and a cassette 314 that are in the form of a drawer and serve as the feed unit 132. The user supplies paper by withdrawing each feed cassette, supplying paper to the withdrawn cassette, and closing the cassette. Similarly, the printer unit 130 has the manual feed unit 134, and the user supplies paper by placing paper in the manual feed unit 134. The manual feed unit 134 also includes the manually inserted paper detection sensor 136 that detects whether or not paper exists in the manual bypass tray, and a manually inserted paper size detection sensor (not shown).

The printer unit 130 feeds printing paper from one of the cassettes 311 to 314 and the manual feed unit 134, and conveys the printing paper to a transfer unit 325 using a conveyance path 331. The transfer unit 325 transfers the developer attached to the photosensitive drum 323 onto the printing paper. The printing paper on which the developer is put is conveyed to a fixing unit 327 by a conveyance belt 326, and the developer is fixed onto the printing paper by the heat and the pressure applied by the fixing unit 327. Thereafter, the printing paper that passed through the fixing unit 327 is discharged through a conveyance path 335 and a conveyance path 334. At this time, in the case of discharging the printing paper with the printing surface thereof inverted, the printing paper is guided up to a conveyance path 336 and a conveyance path 338, is then conveyed in the opposite direction, and is discharged through a conveyance path 337 and the conveyance path 334. If two-sided printing is set, the printing paper after passing through the fixing unit 327 is guided from the conveyance path 336 to a conveyance path 333 by a flapper 329, is thereafter conveyed in the opposite direction, and is guided to the conveyance path 338 and a re-feed conveyance path 332 by the flapper 329. The printing paper that has been guided to the re-feed conveyance path 332 is fed to the transfer unit 325 through the conveyance path 331 at the aforementioned timing. Regardless of one-sided or two-sided printing, the printing paper discharged from the conveyance path 334 is conveyed to the discharge unit 133.

The printing paper conveyed to the discharge unit 133 is first sent to a buffer unit 501. Here, the conveyed printing paper is wrapped around a buffer roller to perform buffering, as appropriate. For example, if processing such as stapling to be performed downstream takes time, the conveyance speed of the printing paper conveyed from the apparatus body can be kept at a fixed speed by using the buffer unit 501, which helps increase throughput. Thereafter, the printing paper is discharged to a discharge tray 507 via a conveyance path 510 due to rotations of an upstream discharge roller pair 502 and a downstream discharge roller pair 503.

In the case of a stapling mode, the printing paper is drawn back by a knurled belt 504 immediately after the printing paper is conveyed by the upstream discharge roller pair 502 and the trailing end of the printing paper finishes passing through the upstream discharge roller pair 502, and is discharged to a stack tray 505. Upon a predetermined number of sheets of printing paper being stacked, stapling processing is performed by a stapling unit 506, and the printing paper is discharged to the discharge tray 507 due to a rotation of the downstream discharge roller pair 503. At the time of shift-sorting, distinction between copies of printed paper is expressed by discharging the paper stacked in the stack tray 505 to the discharge tray 507 while shifting the paper in the leftward and rightward directions.

In the case of usual stapling, stapling is performed after stacking the printing paper discharged from the conveyance path 334 into the stack tray 505. Separately, a manual stapling mode is also provided in which if the user inserts a paper bundle in the stack tray 505 and a paper bundle detection sensor 526 detects the paper bundle, stapling is performed on the paper bundle in the stack tray 505 by the stapling unit 506. The apparatus transitions to this manual stapling mode in accordance with an instruction from a manual stapling mode button 520 or the control unit 110.

Figure 3:
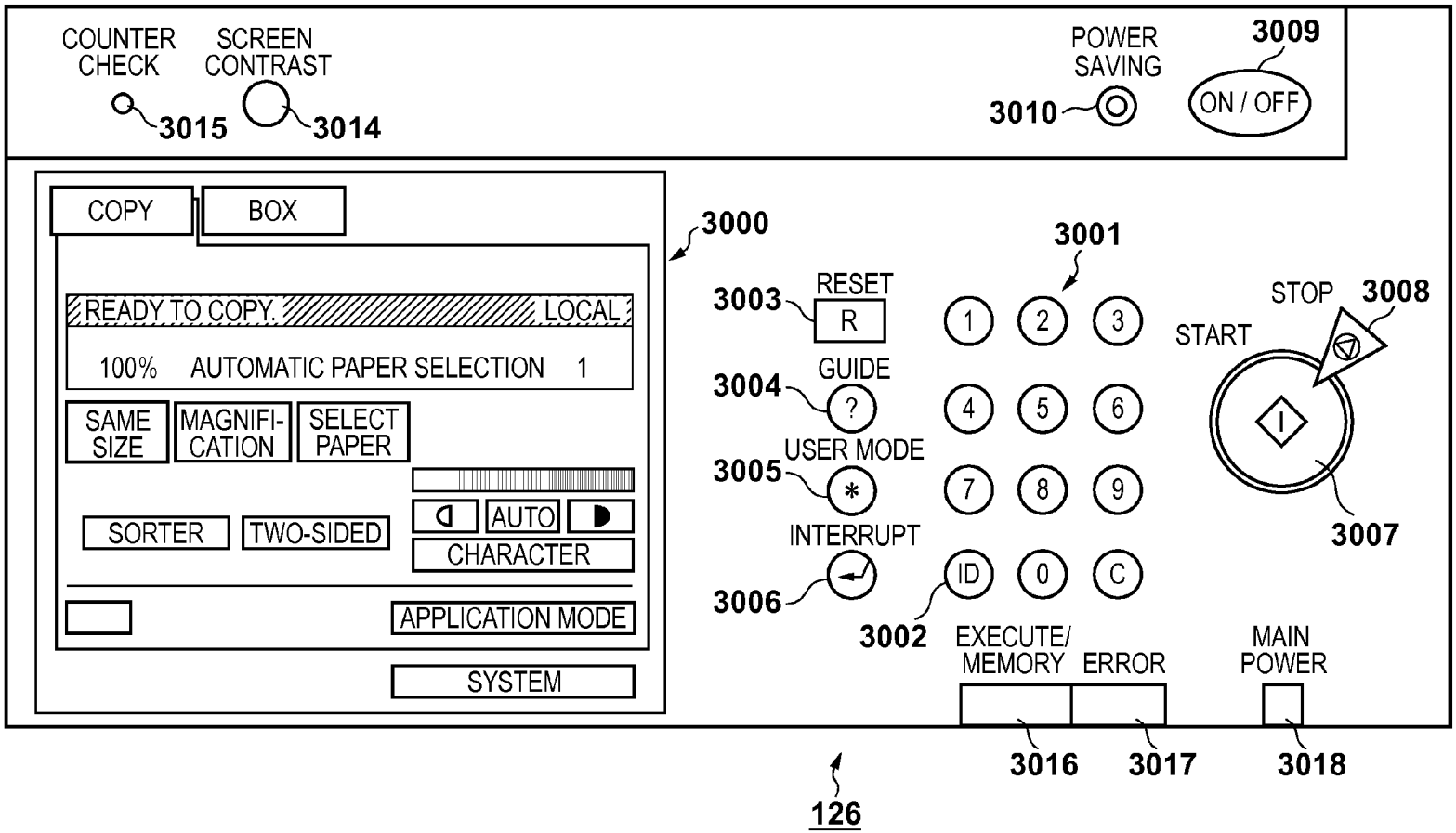
FIG. 3 is a top view of an operation unit in the image forming apparatus.

FIG. 3 is a top view of the operation unit 126 in the image forming apparatus 100 according to the embodiment.

A touch panel 3000 configures main mode settings, displays status, and receives user operations. A ten key 3001 has numeric keys of 0 to 9, and is used for setting a telephone number, the number of copies, and the like. An ID key 3002 is used for inputting, in the case where the image forming apparatus 100 is managed by a division, a division number and a password mode. A reset key 3003 is used for resetting a set mode and the like. A guide key 3004 is for displaying a description screen for each mode. A user mode key 3005 is used for displaying a user mode screen. An interrupt key 3006 is used when performing interrupt copy. A start key 3007 is for starting a copy operation, and a stop key 3008 is for stopping a copy job under execution.

A backlight of the touch panel 3000 is turned off by pressing a soft power source SW3009, and the image forming apparatus 100 transitions to the power-saving state. Upon a power-saving key 3010 being pressed, the apparatus enters the power-saving state, and when the power-saving key 3010 is pressed again, the apparatus returns from the power-saving state. An adjustment key 3014 is used for adjusting the contrast of the touch panel 3000. Upon a counter check key 3015 being pressed, a count screen that displays the total number of copied sheets that have been used so far is displayed on the touch panel 3000. An LED 3016 is lit on during execution of a job, during accumulation of image data in the image memory, and the like. An error LED 3017 is lit in the case of a paper jam, when the door is open, and the like. A power LED 3018 is lit while a main switch of the image forming apparatus 100 is in an on state.

Figure 4A:
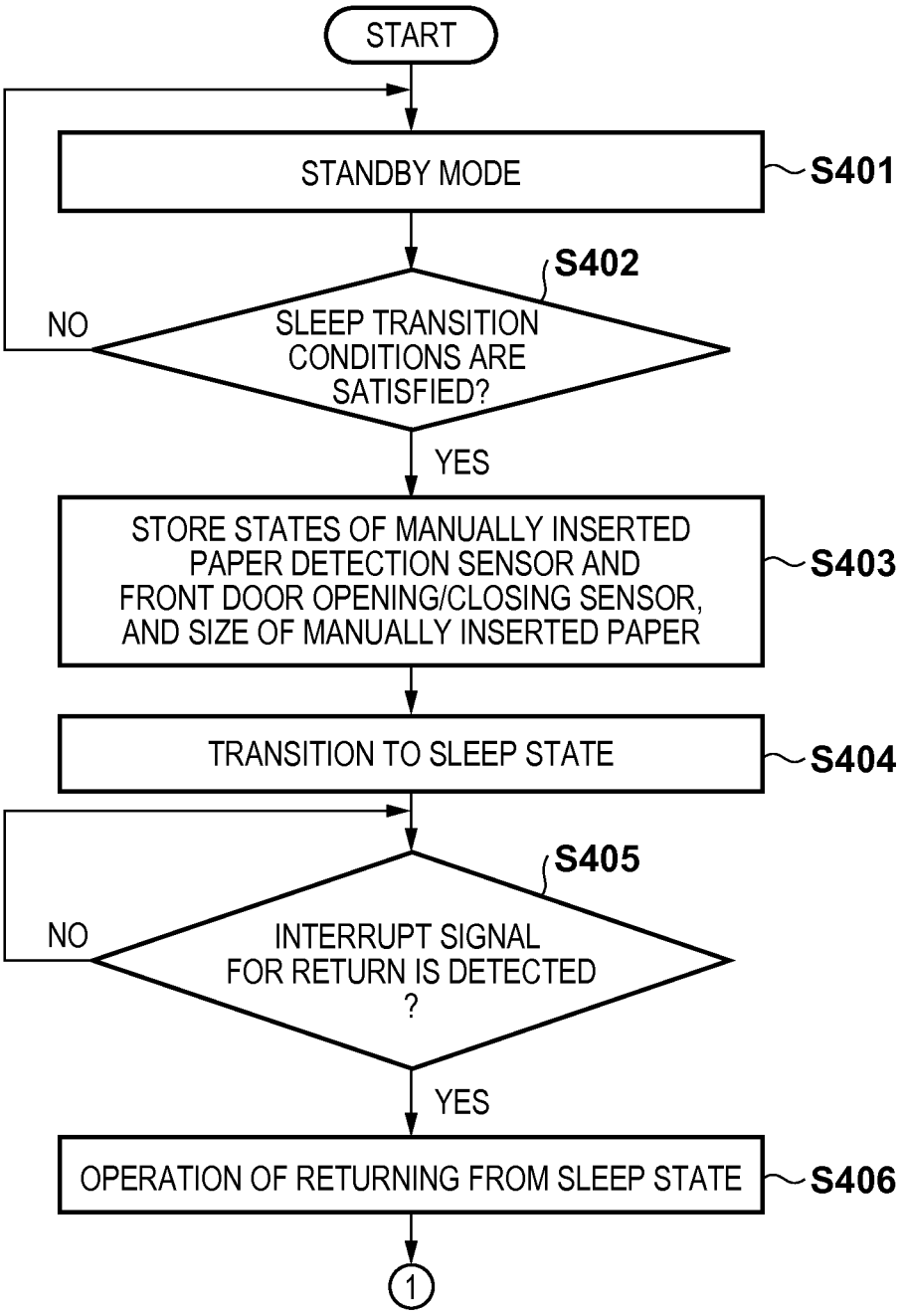
FIGS. 4A and 4B are flowcharts showing processing performed when the image forming apparatus transitions to a power-saving state, and then returns from the power-saving state.
Figure 4B:
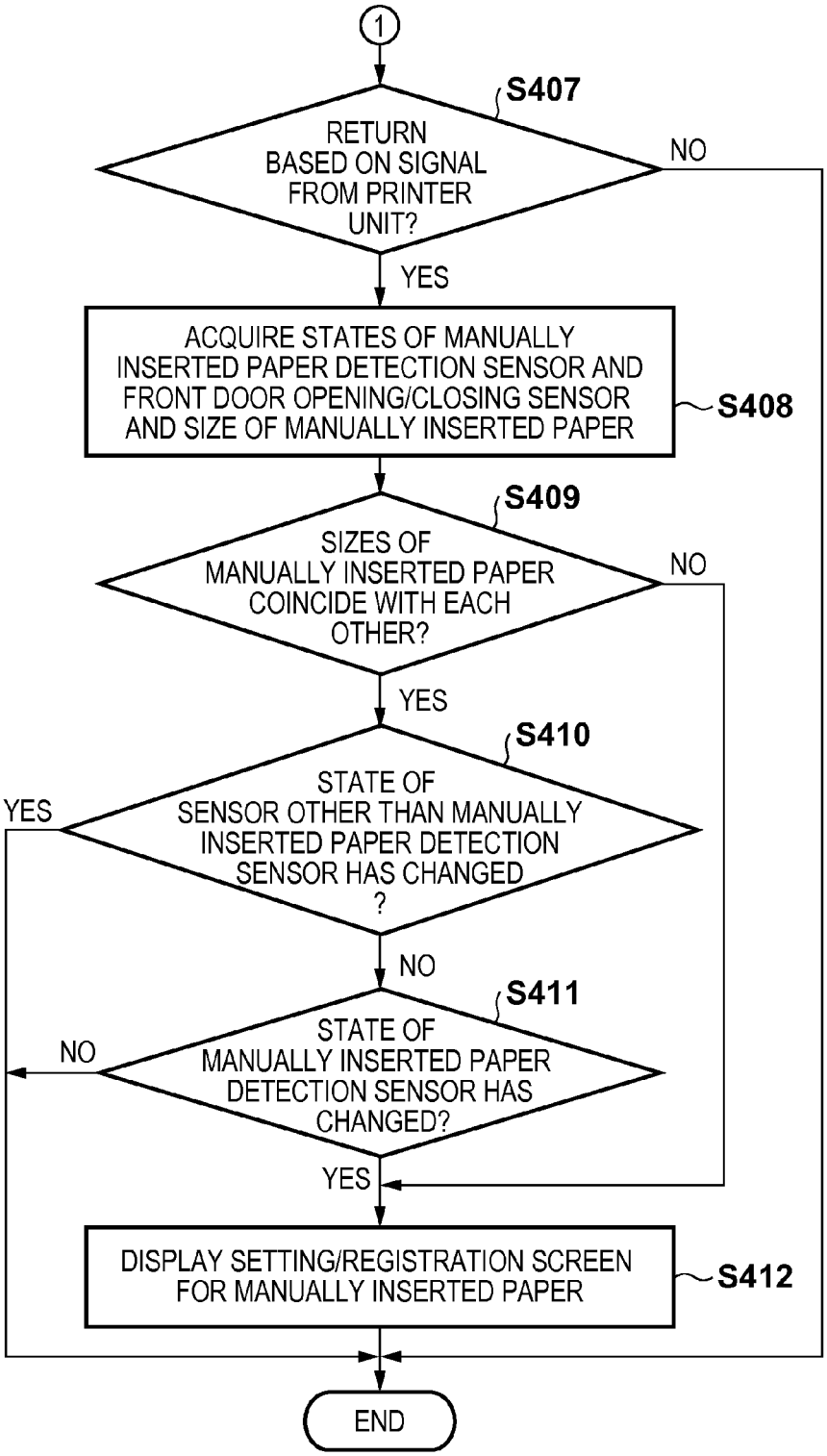

FIGS. 4A and 4B are flowcharts illustrating processing performed when the image forming apparatus 100 according to the embodiment transitions to the power-saving state and then returns from the power-saving state. A program for the processing illustrated in this flowchart is installed in the HDD 116 in the control unit 110, and when the processing is executed, the processing is realized by the CPU 111 deploying the program in the RAM 112 and executing it.

The processing is started by the image forming apparatus 100 being powered on, for example, and initially, in step S401, the image forming apparatus 100 enters the standby mode. Next, the processing proceeds to step S402, and the CPU 111 determines whether or not the preset conditions of transition to the sleep state (power-saving state) are satisfied. Note that this determination processing is executed at intervals of a predetermined time period. If the CPU 111 determines in step S402 that the conditions of transition to the sleep state are satisfied, the processing proceeds to step S403. In step S403, the CPU 111 acquires the states detected by the manually inserted paper detection sensor 136 and the front door opening/closing sensor 135, as well as the paper size of the paper placed in the manual feed unit 134, and stores them in the HDD 116. The processing then proceeds to step S404, and the CPU 111 causes the image forming apparatus 100 to transition to the sleep state, and this sleep state is maintained until an interrupt signal that causes the apparatus to return from the sleep state is input to the CPU 111 in step S405. In this sleep state, the CPU 111 turns off the switches 142 to stop electric power supply to each part, and causes the apparatus to transition to the power-saving state.

In step S405, the CPU 111 determines whether or not the interrupt signal for causing the apparatus to return from the sleep state has been detected, and if the interrupt signal is detected, the processing proceeds to step S406, and the CPU 111 performs an operation of returning from the sleep state. Next, the processing proceeds to step S407, and the CPU 111 determines whether or not the factor in the returning from the sleep state is based on a signal from the printer unit 130. Here, if the CPU 111 determines that the factor in returning from the sleep state is not based on a signal from the printer unit 130, the processing is terminated. On the other hand, if the CPU 111 determines that the returning factor is based on a signal from the printer unit 130, that is to say, input from an OR circuit 151 in FIG. 1, the processing proceeds to step S408. In step S408, the CPU 111 acquires, from the printer control unit 131, the current states of the manually inserted paper detection sensor 136 and the front door opening/closing sensor 135, as well as the size of the paper placed in the manual feed unit 134.

Next, the processing proceeds to step S409, and the CPU 111 compares the size of the manually inserted paper acquired in step S408 with the paper size used before the apparatus transitioned to the sleep state stored in the HDD 116 in step S403. Here, if the CPU 111 determines that these paper sizes coincide with each other, the processing proceeds to step S410, and if not, the processing proceeds to step S412. In step S412, the CPU 111 determines that the returning from the sleep state is based on a change of the paper size of the manually inserted paper, displays the paper setting/registration screen for the manually inserted paper on the touch panel 3000, and terminates the processing.

On the other hand, if the CPU 111 determines in step S409 that paper sizes coincide with each other, the processing proceeds to step S410. In step S410, the CPU 111 determines whether or not the state of a sensor other than the manually inserted paper detection sensor 136 among the states acquired in step S408, e.g., the state of the front door opening/closing sensor 135 has not changed before the apparatus transitioned to the sleep state and after the apparatus returned from the sleep state. If the CPU 111 determines in step S410 that the state detected by the sensor other than the manually inserted paper detection sensor 136 has changed (YES in step S410), this returning from the sleep state is not based on a factor related to a paper change or the like of the manual feed unit 134. Accordingly, in this case, the processing is terminated without the paper setting/registration screen for the manually inserted paper being displayed.

On the other hand, if the CPU 111 determines in step S410 that the state detected by the sensor other than the manually inserted paper detection sensor 136 has not changed, the processing proceeds to step S411. In step S411, the CPU 111 determines whether or not the state of the manually inserted paper detection sensor 136 has changed "from 'no paper' to 'paper is ready'" or "from 'paper is ready' to 'no paper'", before the apparatus transitioned to the sleep state and after the apparatus returned from the sleep state. If the CPU 111 determines in step S411 that the state has changed, the processing proceeds to step S412, and since the CPU 111 can estimate that the factor in the returning from the sleep state is based on a change of the manually inserted paper, the CPU 111 displays the paper setting/registration screen for the manually inserted paper, and terminates this processing. Note that if the CPU 111 determines in step S411 that the state of the manually inserted paper detection sensor 136 has not changed (NO in step S411), the CPU 111 terminates the processing as-is.

Figure 5:
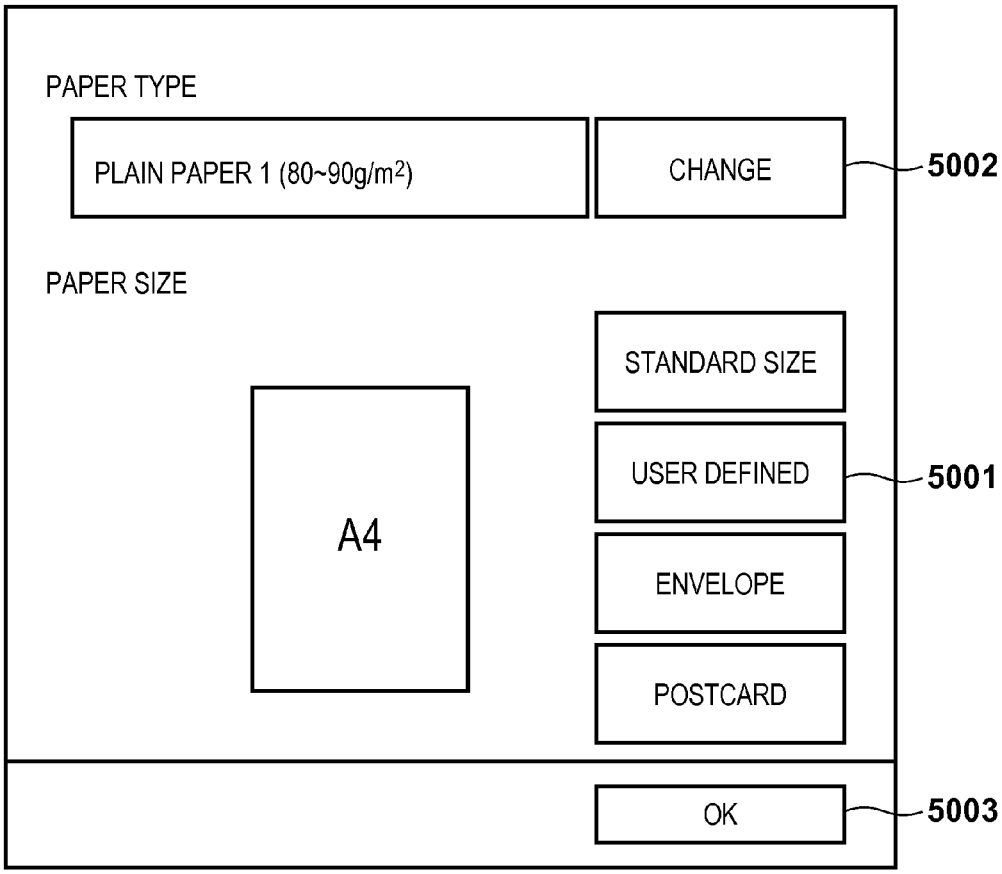
FIG. 5 is a diagram showing an exemplary paper setting/registration screen for manually inserted paper displayed on a touch panel of the operation unit in step S412 in FIG. 4B.

FIG. 5 is a diagram showing an exemplary paper setting/registration screen for manually inserted paper displayed on the touch panel 3000 of the operation unit 126 in step S412 in FIG. 4B.

The paper size and the paper type of the paper placed on the manual feed unit 134 are set on this paper setting/registration screen for manually inserted paper. Here, buttons for "standard size", "envelop", and "postcard", as well as a "user defined" button 5001 with which the user sets an arbitrary paper size are provided. A change button 5002 for changing the type of paper placed in the manual feed unit 134 is also provided. Descriptions of processing to be performed when the respective buttons are pressed will be omitted. After operating these buttons to select desired paper size and paper type, the user presses an OK button 5003 and thereby completes setting and registration of the manually inserted paper.

As a result of performing the above-described control, if the apparatus returns from the sleep state in accordance with a signal from the printer unit 130, it is determined whether the returning from the sleep state is based on a change of manually inserted paper while in the sleep state, even in the case where a detailed returning factor is unknown, and the setting/registration screen for manually inserted paper can be displayed.

Thus, if the user changes the manually inserted paper in the image forming apparatus 100 while in the sleep state, occurrence of the problem caused by the changed paper not being set as the manually inserted paper can be prevented.

As described above, according to the present embodiment, sensor signals serving as the factors in returning from the sleep state are input as a logical sum thereof, and therefore, even if it cannot be determined whether the returning from the sleep state is based on detection of paper in the manual bypass tray, it can be estimated that the returning is based on detection of paper in the manual bypass tray. Then, after it is estimated that the returning is based on detection of paper in the manual bypass tray, the paper setting/registration screen for manually inserted paper is displayed on the display unit in the operation unit. Thus, even if paper in the manual bypass tray is changed while in the sleep state, it is possible to prompt the user to configure settings of the paper in the manual bypass tray when the apparatus returns from the sleep state. For this reason, occurrence of a situation where a print job causes unintended paper fed from the manual bypass tray to be printed can be prevented.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment of the present invention, and by a method performed by the computer of the system or apparatus by, for example, reading out and executing the computer executable instructions from the storage medium to perform the functions of one or more of the above-described embodiment. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-171710, filed Aug. 21, 2013, which is hereby incorporated by reference herein in its entirety.

What is claimed is:

1. An image forming apparatus having a first electric power state and a second electric power state in which power consumption is smaller than that in the first electric power state, the image forming apparatus comprising:

a transition unit configured to cause the image forming apparatus to transition from the first electric power state to the second electric power state, and to transition from the second electric power state to the first electric power state;

a detector configured to detect a size of a sheet set in a sheet holder; and a controller configured to determine whether or not to display, after the image forming apparatus transitions from the second electric power state to the first electric power state, a screen for making a setting regarding the sheet set in the sheet holder on a display device, in accordance with a first size, which is detected by the detector when the image forming apparatus transitions from the first electric power state to the second electric power state, and a second size, which is detected by the detector when the image forming apparatus transitions from the second electric power state to the first electric power state, wherein at least one of the transition unit, the detector, and the controller is implemented by a CPU executing computer-executable code stored in a non-transitory computer-readable memory.

2. The image forming apparatus according to claim 1, wherein the controller is further configured to cause the display device to display the screen in a case where the second size is different from the first size, and not to cause the display device to display the screen in a case where the second factor the second size is same as the first size.

3. The image forming apparatus according to claim 1, wherein the screen is a setting screen for allowing a user to set a size or a type of the sheet set in the sheet holder.

4. The image forming apparatus according to claim 1, wherein the controller is configured to determine whether or not to display the screen further in accordance with a detection result of another detector, which is different from the detector.

5. A method for controlling an image forming apparatus having a first electric power state and a second electric power state in which power consumption is smaller than that in the first electric power state, the method comprising steps of:

causing the image forming apparatus to transition from the first electric power state to the second electric power state, and to transition from the second electric power state to the first electric power state;

detecting a size of a sheet set in a sheet holder; and determining whether or not to display, after the image forming apparatus transitions from the second electric power state to the first electric power state, a screen for making a setting regarding the sheet set in the sheet holder on a display device, in accordance with a first size, which is detected in the detecting step when the image forming apparatus transitions from the first electric power state to the second electric power state, and a second size, which is detected in the detecting step when the image forming apparatus transitions from the second electric power state to the first electric power state.

6. A non-transitory computer-readable storage medium storing a program for controlling an image forming apparatus having a first electric power state and a second electric power state in which power consumption is smaller than that in the first electric power state, that when executed causes a computer to perform steps of:

causing the image forming apparatus to transition from the first electric power state to the second electric power state, and to transition from the second electric power state to the first electric power state;

detecting a size of a sheet set in a sheet holder; and determining whether or not to display, after the image forming apparatus transitions from the second electric power state to the first electric power state, a screen for making a setting regarding the sheet set in the sheet holder on a display device, in accordance with a first size, which is detected in the detecting step when the image forming apparatus transitions from the first electric power state to the second electric power state, and a second size, which is detected in the detecting step when the image forming apparatus transitions from the second electric power state to the first electric power state.

7. An image forming apparatus having a first electric power state and a second electric power state in which power consumption is smaller than that in the first electric power state, the image forming apparatus comprising:

a transition unit configured to cause the image forming apparatus to transition from the first electric power state to the second electric power state, and to transition from the second electric power state to the first electric power state;

a detector configured to detect an existence of a sheet set in a sheet holder; and a controller configured to determine whether or not to display, after the image forming apparatus transitions from the second electric power state to the first electric power state, a screen for making a setting regarding the sheet set in the sheet holder on a display device, in accordance with a first detection result of the existence of the sheet when the image forming apparatus transitions from the first electric power state to the second electric power state, and a second detection result of the existence of the sheet when the image forming apparatus transitions from the second electric power state to the first electric power state, wherein at least one of the transition unit, the detector, and the controller is implemented by a CPU executing computer-executable code stored in a non-transitory computer-readable memory.

8. The image forming apparatus according to claim 7, wherein the controller is further configured to cause the display device to display the screen in a case where the first detection result indicates that the sheet does not exist and the second detection result indicates that the sheet exists, and not to cause the display device to display the screen in a case where both of the first detection result and the second detection result indicate that the sheet exists.

9. The image forming apparatus according to claim 7, wherein the screen is a setting screen for allowing a user to set a size or a type of the sheet set in the sheet holder.

10. A method for controlling an image forming apparatus having a first electric power state and a second electric power state in which power consumption is smaller than that in the first electric power state, the method comprising steps of:

causing the image forming apparatus to transition from the first electric power state to the second electric power state, and to transition from the second electric power state to the first electric power state;

detecting an existence of a sheet set in a sheet holder; and determining whether or not to display, after the image forming apparatus transitions from the second electric power state to the first electric power state, a screen for making a setting regarding the sheet set in the sheet holder on a display device, in accordance with a first detection result of the existence of the sheet when the image forming apparatus transitions from the first electric power state to the second electric power state, and a second detection result of the existence of the sheet when the image forming apparatus transitions from the second electric power state to the first electric power state.

11. A non-transitory computer-readable storage medium storing a program for controlling an image forming apparatus having a first electric power state and a second electric power state in which power consumption is smaller than that in the first electric power state, that when executed causes a computer to execute steps of:

causing the image forming apparatus to transition from the first electric power state to the second electric power state, and to transition from the second electric power state to the first electric power state;

detecting an existence of a sheet set in a sheet holder; and determining whether or not to display, after the image forming apparatus transitions from the second electric power state to the first electric power state, a screen for making a setting regarding the sheet set in the sheet holder on a display device, in accordance with a first detection result of the existence of the sheet when the image forming apparatus transitions from the first electric power state to the second electric power state, and a second detection result of the existence of the sheet when the image forming apparatus transitions from the second electric power state to the first electric power state.

12. The image forming apparatus according to claim 7, wherein the controller is configured to determine whether or not to display the screen further in accordance with a detection result of another detector, which is different from the detector.

* * * * *